United States Patent [19]

Johnson

[11] 4,448,582

[45] May 15, 1984

[54] PROCESS FOR CONTINUOUS THERMOSOL DYEING OF TEXTILE FABRICS

[75] Inventor: David F. Johnson, Charlotte, N.C.

[73] Assignee: American Artos Corporation, Charlotte, N.C.

[21] Appl. No.: 344,405

[22] Filed: Feb. 1, 1982

[51] Int. Cl.[3] ..... D06B 5/08; D06B 21/00

[52] U.S. Cl. ..... 8/149.1; 8/149.2; 8/933; 26/92; 34/155; 34/158; 68/5 D; 68/20

[58] Field of Search ..... 8/149.1, 149.2, 505, 8/933; 68/5 D, 5 E, 20; 26/92; 34/155, 158

[56] References Cited

U.S. PATENT DOCUMENTS

| | | | |
|---|---|---|---|
| 2,597,529 | 5/1952 | Redman | 34/155 X |
| 3,118,154 | 1/1964 | Osban et al. | 8/149.1 |
| 3,371,427 | 3/1968 | Thygeson, Sr. | 26/92 X |
| 3,567,356 | 3/1971 | Von Der Eltz et al. | 68/DIG. 5 |
| 3,750,428 | 8/1973 | Bruckner | 68/20 X |
| 3,837,796 | 9/1974 | Fleissner et al. | 8/933 X |
| 3,943,734 | 3/1976 | Fleissner | 68/5 D |
| 4,025,305 | 5/1977 | Fleissner | 68/5 D X |
| 4,121,311 | 10/1978 | Meyer | 68/5 D X |
| 4,345,385 | 8/1982 | Sando et al. | 68/5 D X |

FOREIGN PATENT DOCUMENTS

| | | | |
|---|---|---|---|
| 479804 | 12/1951 | Canada | 68/5 D |

*Primary Examiner*—Philip R. Coe

*Attorney, Agent, or Firm*—Bell, Seltzer, Park & Gibson

[57] ABSTRACT

A textile fabric formed of synthetic fibrous material or blends with natural fibers to which dyestuffs have been applied is subjected to a thermosol heat treatment by directing the fabric supported on an air permeable conveyor through a heated oven while directing heated air downwardly through the fabric and through the underlying supporting conveyor and while at predetermined longitudinally spaced locations as the fabric travels through the oven directing heated air upwardly through the open mesh conveyor and into contact with the fabric so as to lift portions of the fabric from the conveyor to permit free shrinkage and bulking of the fabric while avoiding distortion of the fabric or obtaining an undesirable ironed surface appearance as would occur if the fabric were pinned to the conveyor. This method also achieves very rapid and efficient heat transfer to the fabric and thus avoids the extreme time and temperature conditions which result in harsh treatment of the fabric.

4 Claims, 4 Drawing Figures

PROCESS FOR CONTINUOUS THERMOSOL DYEING OF TEXTILE FABRICS

FIELD AND BACKGROUND OF THE INVENTION

The present invention relates to an improved process for the thermosol dyeing of textile fabrics formed of synthetic fibers.

In the process known as thermosol dyeing, a textile fabric formed of synthetic fibrous materials or blends of synthetic and natural fibers is printed or padded with a suitable preparation of dyestuffs, and the fabric is thereafter subjected to a thermosol heat treatment which fixes the dyestuffs on the synthetic fibers. The conventional method of thermosol heat treatment is carried out on a tenter frame wherein the fabric is gripped along opposite side edges by pins or clamps and transported through an oven where heated air is blown over the fabric. The time and temperature conditions to which the fabric is subjected are quite severe, with the temperature of the fabric approaching the softening point of the fibers. This results in harsh treatment to the fabric which is particularly troublesome with knit fabrics. Because of their delicate nature, knit fabrics are often distorted or stretched during the thermosol heat treatment.

It has been proposed in U.S. Pat. Nos. 3,567,356 and 3,837,796 to carry out the thermosol heat treatment with a drum dryer which directs air through the fabric rather than across the surface in order to hasten the fixation of the dyestuff and to thus reduce mistreatment of the fabric during the thermosol heat treatment. The particular dryer disclosed in the aforementioned patents utilizes a series of rotating perforated cylindrical drums and the fabric is transported along the surface of the rotating drums while heated air is directed through the fabric and through perforated drum and into the interior of the drum. While this drum type flow through dryer does tend to reduce mistreatment of the fabric during the thermosol heating treatment, it nevertheless has certain disadvantages or limitations. In particular, the flow through drum dryer disclosed in the aforementioned patents tends to distort the fabric and produce an undesirable ironed surface appearance since the fabric is held tightly against the surface of the drum by the flowing air. This holding of the fabric to the drum also restricts the ability to obtain longitudinal shrinkage of the fabric during the thermosol heating treatment.

With the foregoing in mind, it is a primary object of the present invention to eliminate the problems encountered with the thermosol heat treatment processes heretofore available. More specifically, it is an object of this invention to provide a method for the continuous thermosol dyeing of textile fabrics which reduces mistreatment and distortion of the fabric and which leaves the fabric with a desirable natural surface appearance.

SUMMARY OF THE INVENTION

In accordance with the present invention, a textile fabric formed at least partially of synthetic fibrous material to which dyestuffs have been applied is subjected to a thermosol heat treatment by directing the fabric supported on an air permeable conveyor through a heated oven while directing heated air downwardly through the fabric and through the underlying supporting conveyor and while at predetermined longitudinally spaced locations as the fabric travels through the oven directing heated air upwardly through the conveyor and into contact with the fabric so as to lift portions of the fabric from the conveyor to permit free shrinkage and bulking of the fabric while avoiding distortion of the fabric or obtaining an undesirable ironed surface appearance, as would occur if the fabric remained held to the conveyor. This method also achieves very rapid and efficient heat transfer to the fabric and thus avoids the extreme time and temperature conditions which result in harsh treatment of the fabric.

This treatment process can be carried out with or without width control of the fabric. However, the process particularly lends itself for the use of a tenter frame in the curing oven to provide for width control while overfeeding of the fabric in the length direction to allow for shrinkage and bulking in the length direction.

While the treatment process is particularly beneficial in the thermosol dyeing of delicate knit fabrics which are easily distorted or stretched, the treatment process may also be applied to woven fabrics.

BRIEF DESCRIPTION OF THE DRAWINGS

Some of the features and advantages of the invention having been stated, others will become apparent as the description proceeds, when taken in connection with the accompanying drawings, in which—

DESCRIPTION OF ILLUSTRATED EMBODIMENT

Figure 1:
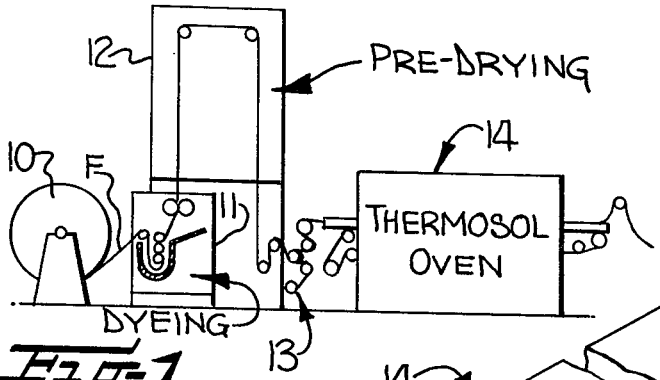
FIG. 1 is a schematic view showing an arrangement of apparatus for carrying out the thermsol dyeing and heat treatment process of the present invention.

Referring now more particularly to the drawings, FIG. 1 illustrates an arrangement of apparatus for carrying out the thermosol dyeing and heat treatment process of the present invention. As illustrated therein, a textile fabric F formed of synthetic polyester fibrous material or blends thereof with natural fibers is continuously directed from a suitable supply source, such as a supply roll 10, and into and through a padding apparatus 11 where a suitable preparation of dyestuffs is applied to the fabric F. The detailed construction of the padding apparatus 11 and details concerning the composition of the dyestuffs and the manner of its application to the fabric F in the padding apparatus 11 are well known to persons familiar with thermosol dyeing, and a detailed discussion is therefore not deemed warranted.

From the padding apparatus 11 the fabric F is directed through a predryer 12 where heated air is circulated into contact with the advancing fabric to dry the fabric to a moisture content suitable for the thermosol heating treatment.

The predried fabric emerges from the predryer 12 and is directed over a series of guide rolls 13 and thence into and through a thermosol curing oven, generally indicated by the reference character 14. In the thermosol oven the fabric is subjected to temperature conditions suitable for effecting thermosoling of the fabric. Upon emerging from the oven 14, the fabric may be subjected to other conventional processing steps not illustrated, such as washing, drying, resin treatment, etc.

In accordance with the present invention, the fabric is carried through the thermosol curing oven on an open mesh supporting conveyor while heated air is directed into contact with the fabric from each side. More specifically, the heated air is directed continuously downwardly through the fabric and through the underlying conveyor to thereby rapidly heat the synthetic fibers and set the dyestuffs. To prevent the fabric from obtaining an undesirable ironed or pressed surface appearance due to being pinned to the supporting conveyor by the downwardly flowing air, the fabric is partially lifted from the conveyor and agitated as it advances through the dryer. This is accomplished by directing air upwardly into impingement with the fabric at several locations along the length of the dryer. This lifting and agitation of the fabric also facilitates free shrinkage and bulking of the fabric since the fabric is in an essentially tensionless condition at this time.

Figure 3:
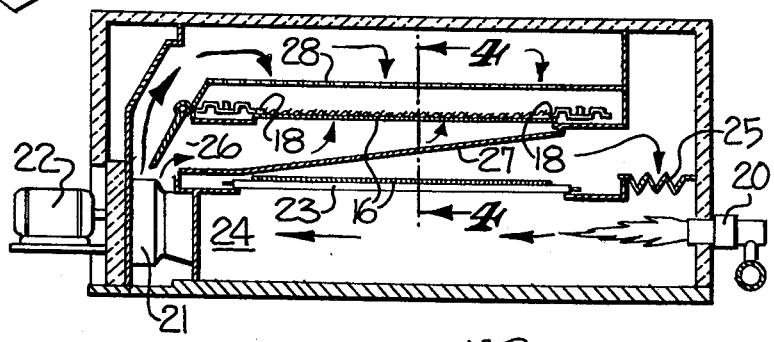
FIG. 3 is a cross-sectional view of the oven taken substantially along the line 3—3 of FIG. 2.
Figure 4:
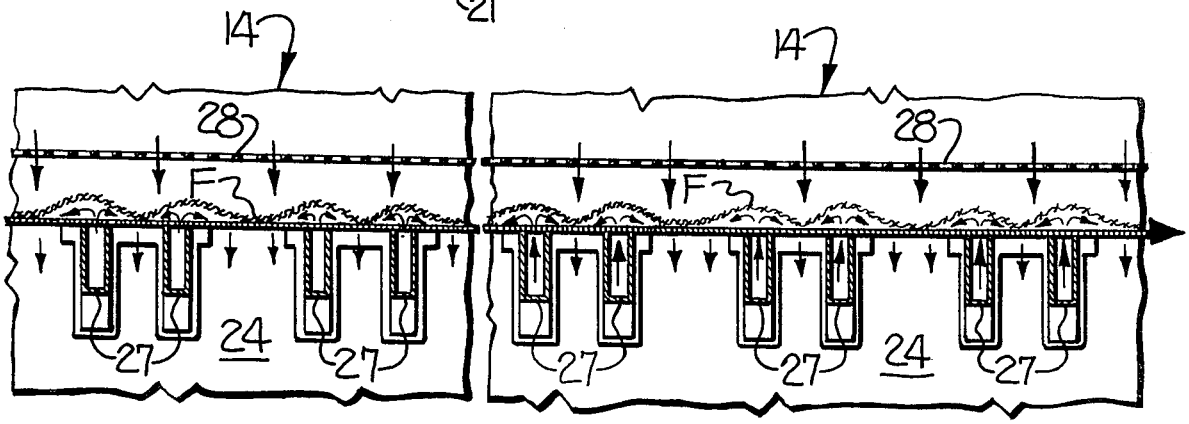
FIG. 4 is an enlarged fragmentary detailed view of the interior of the oven taken substantially along the line 4—4 of FIG. 3 and showing the flow of heated air both downwardly through the fabric and through the underlying open mesh supporting conveyor as well as upwardly into contact with the fabric to lift the fabric from the supporting conveyor.

An apparatus particularly suited for use as a thermosol curing oven for carrying out the thermosol heating process in the manner just described is the AEROVAR Modified Flow-Through Dryer available from American Artos Corporation of Charlotte, N.C. [AEROVAR is a registered trademark of Babcock Textilmaschinen KG (GmbH)]. This apparatus is illustrated in FIGS. 2 to 4.

Figure 2:
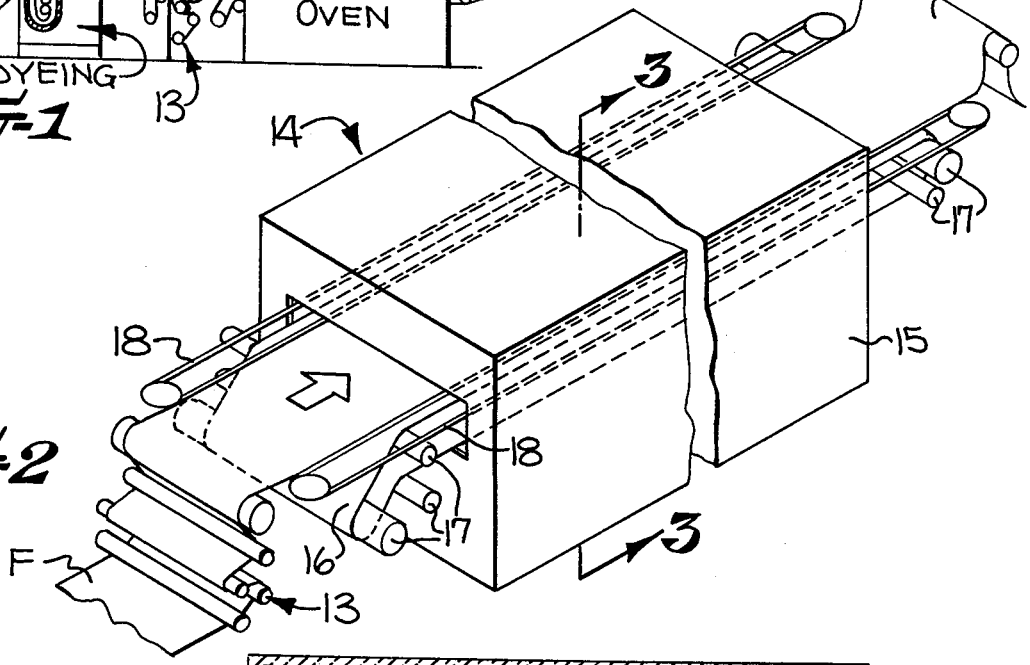
FIG. 2 is a fragmentary perspective view showing the thermosol heat treatment oven used in the process of this invention.

Referring now in detail to FIG. 2, it will be seen that the thermosol heat treatment oven 14 includes an elongate housing 15 with an inlet at one end and an outlet at the opposite end through which the fabric passes in its course of travel through the oven. An endless supporting conveyor 16 of an air permeable open mesh construction extends longitudinally through the housing 15 for supportingly conveying the fabric thereon. Suitable rolls or pulleys 17 are provided at each end of the housing for guiding the conveyor in an endless path of travel longitudinally through the housing 15 with the upper run of the belt being positioned for receiving the fabric at the inlet end and for supporting and conveying the fabric through the housing and with the lower run of the belt serving to return the belt from the discharge end to the inlet end. The fabric F is deposited onto the conveyor 16 by the guide rolls 13 at a slight overfeed so that the fabric is in a substantially tensionless condition to allow for longitudinal shrinkage and bulking of the fabric as it is advanced through the oven 14.

In some instances, especially with knit fabrics, it may be desirable to maintain control over the width of the fabric during the thermosol heat treatment, and in this event the fabric may be advanced through the oven supported on the conveyor 16 in a longitudinally overfed condition so as to allow for free shrinkage and bulking in the length direction and while also maintaining control over the width dimension of the fabric. For these purposes it will be seen that in the embodiment illustrated, the thermosol curing oven 14 is also equipped with a pair of endless tenter chains 18 which extend longitudinally through the housing adjacent opposite side edges of the conveyor belt 16. The tenter chains 18 are equipped with pins or clips as is conventional and are adapted for grippingly engaging the selvages of the fabric F so as to maintain control over the width of the fabric as it passes through the oven.

Within the housing 15 means is provided for creating a flow of heated air for heating the fabric up to the temperature required for thermosoling. Heating of the air is accomplished by a heater 20 located in the lower portion of the housing. In the particular embodiment illustrated, the heater 20 comprises a gas-fired burner, although it will be readily appreciated that other types of heaters can be suitably employed. The heated air is circulated throughout the housing by a suitable radial flow fan 21 (FIG. 3) located within the housing adjacent one of the side walls. The fan 21 is powered by a motor 22 located outside of the housing. A wall 23 extends horizontally within the housing just beneath the lower run of the belt 16 and serves to form an enclosed plenum area 24 in the lower portion of the housing where the air is heated prior to being directed by the fan into the upper portion of the housing. An air permeable lint screen 25 allows the air from the upper portion of the housing to return to the plenum area 24 to be heated by the heater 20 and recirculated to the upper portion of the housing by the fan 21.

As seen in FIG. 3 the fabric F is carried longitudinally through the housing on the upper run of conveyor 16. The tenter chains 18 engage the selvages of the fabric and thereby control the fabric width during its travel through the housing. Beneath the upper run of the conveyor belt 16, a series of air ducts 27 extend across the width of the fabric and in spaced relation with respect to one another, the inlet end of the ducts 27 communicating with the discharge side of the fan 21.

A pivotally mounted damper means 26 is provided adjacent the discharge of the fan 21 for controlling the path of flow of the heated air toward the fabric. The damper means 26 divides the flow of heated air, sending a portion thereof upwardly into the uppermost portions of the housing while sending the remaining portion into the ducts 27. Preferably, the damper 26 is adjusted so that the major portion of the air flow is directed into the uppermost portion of the housing.

The portion of the air which reaches the uppermost part of the housing passes downwardly through an air permeable wall 28, which serves for diffusing and more uniformly distributing the heated air, and then flows downwardly through the fabric F and through the underlying conveyor 16, passing between the air ducts 27 and then flowing through the lint screen 25 and being recirculated through the dryer housing as previously described. Because the air actually passes through the fabric rather than merely across the surface thereof, the heat transfer to the fabric is highly efficient and the period of heating required for fixing of the dyestuffs in the thermosoling process is thus considerably shorter than that required by conventional thermosoling processes at the same temperature where the heated air merely passes over the fabric.

The portion of the heated air from fan 21 which is directed into the horizontally extending air ducts 27 is discharged therefrom upwardly through the conveyor 16 and into impingement with the advancing fabric F. As a result, the fabric is lifted from the conveyor 16, as illustrated in FIG. 4. As the fabric advanced longitudinally through the dryer on the conveyor, it is repeatedly lifted each time it passes one of the ducts 27. Repeated periodic lifting of the fabric from the conveyor in this manner facilitates free shrinkage and bulking of the fabric during the thermosoling heat treatment and avoids obtaining an undesirable pressed or ironed surface appearance on the fabric due to the fabric being pinned or nailed to the conveyor 16 by the downward flow of air therethrough.

Upon emerging from the thermosol oven 14, the fabric F is lifted from the conveyor by a suitable guide roll 31 and then directed through other fabric finishing operations, such as washing, drying and resin treatment, as is conventional.

In the drawings and specification, there has been set forth a preferred embodiment of the invention, and although specific terms are employed, they are used in a generic and descriptive sense only and not for purposes of limitation.

That which is claimed is:

1. In a process for the continuous thermosol dyeing of a textile fabric formed at least partially of synthetic fibrous material, said process including the steps of applying dyestuffs to the fabric and thereafter heating the fabric to fix the dyestuffs on the fibers, the improvement which comprises carrying out said heating step by directing the fabric onto an air permeable supporting conveyor and conveying the fabric supported on said conveyor longitudinally through an elongate heated oven while directing heated air downwardly through the fabric and through the underlying supporting conveyor and while at predetermined longitudinally spaced locations as the fabric travels through the oven directing heated air upwardly through the supporting conveyor and into impingement with the fabric so as to lift portions of the fabric from the supporting conveyor to permit free shrinkage and bulking of the fabric while avoiding distortion of the fabric or obtaining an undesirable ironed surface appearance.

2. A process according to claim 1 wherein said step of directing the fabric onto an air permeable supporting conveyor comprises continuously depositing the fabric in an overfed condition on the supporting conveyor.

3. In a process for the continuous thermosol dyeing of a textile fabric formed at least partially of synthetic fibrous material, said process including the steps of applying dyestuffs to the fabric and thereafter heating the fabric to fix the dyestuffs on the synthetic fibers, the improvement which comprises carrying out said heating step by directing the fabric onto an air permeable supporting conveyor and also grippingly engaging the opposing side edges of the fabric and conveying the fabric supported on said conveyor through an elongate heated oven while maintaining a predetermined distance between the side edges of the fabric so as to thereby control the width of the fabric while maintaining the fabric in an overfed condition in the length direction to permit lengthwise shrinkage and while directing heated air continuously downwardly through the fabric and through the underlying supporting conveyor and while at predetermined longitudinally spaced locations as the fabric travels through the oven directing heated air upwardly through the conveyor and into impingement with the fabric so as to lift portions of the fabric from the supporting conveyor to permit free shrinkage and bulking of the fabric in the length direction while maintaining control over the width of the fabric and while avoiding distortion of the fabric or obtaining an undesirable ironed surface appearance.

4. In a process for the continuous thermosol dyeing of a textile fabric formed at least partially of synthetic fibrous material, said process including the steps of applying dyestuffs to the fabric and thereafter heating the fabric to fix the dyestuffs on the fibers, the improvement which comprises carrying out said heating step by directing the fabric in an overfed condition onto an air permeable supporting conveyor and conveying the fabric supported on said conveyor longitudinally through an elongate heated oven while circulating heated air through the oven and while directing a portion of the circulating heated air into the upper portion of the oven and then downwardly through the fabric and through the underlying supporting conveyor so as to rapidly heat the fabric and fix the dyestuffs and while directing the remaining portion of the circulating heated air into ducts located beneath the conveyor and arranged at spaced apart locations along the longitudinal path of travel of the fabric through the oven and discharging the heated air from the ducts upwardly through the supporting conveyor and into impingement with the fabric so as to lift from the supporting conveyor the portions of the fabric located above the ducts to thereby permit free shrinkage and bulking of the fabric while avoiding distortion of the fabric or obtaining an undesirable ironed surface appearance.

* * * * *